United States Patent [19]

Mallow

[11] Patent Number: 4,513,862

[45] Date of Patent: Apr. 30, 1985

[54] SCENTED TISSUE-DISPENSING CONTAINER

[76] Inventor: Peter Mallow, 450 Seventh Ave., New York, N.Y. 10123

[21] Appl. No.: 476,765

[22] Filed: Mar. 18, 1983

[51] Int. Cl.[3] ..... B65D 5/08

[52] U.S. Cl. ..... 206/233; 206/213.1; 206/494; 206/823

[58] Field of Search ..... 206/232, 233, 210, 494, 206/581, 39.7, 823, 44.11, 213, 213.1; 220/87

[56] References Cited

U.S. PATENT DOCUMENTS

| | | | |
|---|---|---|---|
| 1,103,880 | 7/1914 | Johnson | 206/44.11 |
| 1,217,375 | 2/1917 | Warren | 206/44.11 |
| 1,546,302 | 7/1925 | Mchigan | 206/232 |
| 1,942,224 | 1/1934 | Stone | 206/213 |
| 1,983,691 | 12/1934 | Bonardi | 206/0.5 |
| 2,305,003 | 12/1942 | Heit | 206/233 |
| 2,514,902 | 7/1950 | Sabath | 220/87 |
| 3,154,798 | 11/1964 | Harris et al. | 206/213 |
| 3,711,024 | 1/1973 | Hammond | 206/213.1 |

FOREIGN PATENT DOCUMENTS

| | | | |
|---|---|---|---|
| 145709 | 1/1936 | Fed. Rep. of Germany | 206/44.11 |
| 881585 | 4/1943 | France | 206/44.11 |
| 466222 | 5/1937 | United Kingdom | 206/44.11 |

*Primary Examiner*—William T. Dixson, Jr.
*Assistant Examiner*—Brenda J. Ehrhardt
*Attorney, Agent, or Firm*—Bauer & Amer

[57] ABSTRACT

The combination with a paper tissue-dispensing box of a scent-imparting sachet, in which the supply stack of tissues acts as a closure for the box and provides a confined area, i.e., much like a bureau drawer, in which the sachet is able to impart its scent effectively over a prolonged period to the tissues removed therefrom one at a time.

1 Claim, 4 Drawing Figures

SCENTED TISSUE-DISPENSING CONTAINER

The present invention relates generally to improvements in imparting a pleasant scent to paper tissues, and more particularly to effectively combining a sachet-scent source with a tissue-dispensing box so that the scent is imparted to the tissues rather than merely dissipated to atmosphere.

As understood, a scent-imparting sachet is effective over a prolonged period of time only when used in a confined area, such as a bureau drawer, but is dissipated in a very short period of time when left in an open, unconfined area. Thus, the combination with a paper tissue-dispensing box, which is used in an open area, has not heretofore been commercially successful, nor does it have the promise of being a utilitarian combination in which the scent-imparting function of the sachet is for a long enough period to be of benefit.

Broadly, it is an object of the present invention to provide an improved sachet-tissue box combination overcoming the foregoing and other shortcomings of the prior art.

Specifically, it is an object to internally locate the sachet in relation to the supply stack of tissues so that the absorbency of the tissues promotes the travel of the scent towards the interior of the tissue box, which interior further is maintained as a confined area, i.e. like a bureau drawer, by the tissues themselves, which are only removed usually one at a time.

A sachet-tissue box combination demonstrating objects and advantages of the present invention includes, in combination (1) a tissue-dispensing container of cardboard construction material of the type having walls including opposite side walls bounding a storage compartment and a stored supply stack of paper tissues disposed in said storage compartment, and (2) a selected scent disposed in a packet of slightly smaller size than one said container side wall, said packet having an operative position in contact with said supply stack of tissues provided by an interposed position thereof between said tissue supply stack and one said side wall, and wherein further provision is made to have opposite sides of the packet project through cooperating vertically oriented slits in the container side wall. As a result, the tissues that are removed one at a time from the container are imparted with the scent of the packet by reason of their adjacent position to the packet, and the confined storage compartment presented by the box is effectively maintained so as to contribute to prolonging the time duration of the availability of the scent.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein.

It is already a well known practice to advantageously place a sachet in a drawer or other confined area to impart a pleasant scent to the contents of the drawer. The scent emanating from and imparted by the sachet is, however, only available for an appreciable period of time because of the confined nature of the area in which it is used. In other words, if the sachet which lasts a significant period of time in a confined area, such as a drawer, is instead left in an open area, the scent is dissipated in a very short period of time into the atmosphere. It is undoubtedly for this reason that heretofore a sachet has never been successfully combined with articles whose utility would manifestly be enhanced by being imparted with a pleasant scent. One such article is a supply stack of paper tissues of the type used for personal hygiene which are used in the vicinity of the nose and face and would benefit considerably if imparted with a pleasant scent.

Underlying the present invention is the recognition that a tissue-dispensing box or container, although located in an open area, nevertheless affords the same opportunity as a confined area of being successfully or effectively combined with a sachet for imparting a scent over a prolonged period to the individual tissues being disposed therefrom. More particularly, and referring to FIG. 2, it will be understood that there is illustrated therein a conventional tissue container or box 10, of cardboard construction material, from which paper tissues are dispensed, one at a time, from an opening 12. In accordance with the present invention, it has been recognized that although box 10 has an opening 12 into its interior, that said interior is nevertheless insulated, so to speak, from the atmosphere, by virtue of the supply stack of tissues 14 being disposed in the interior compartment of the box 10 and remaining therein except as each tissue is removed one at a time from said supply stack. In other words, and as generally understood, most of the supply stack of tissues 14 remains intact within the interior compartment of the box 10 and thus, in this respect, the tissues 14 themselves function as a closure for the opening 12.

Based on the recognition that the tissues 14 function as a closure for the opening 12, it has thus been possible to achieve a successful or effective combination between a sachet and the paper tissues 14, wherein each individual tissue is imparted with the scent from the sachet and the sachet is capable of providing this scent-imparting function to the tissues over a prolonged period of time.

Figure 1:
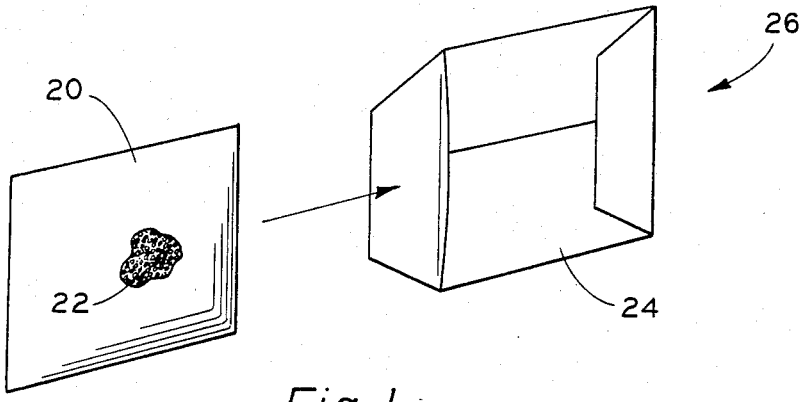
FIG. 1 is a perspective view of one of the components used in the within inventive combination, namely, the component which is the source of the scent used therein.

Referring now to FIG. 1, it will be understood that disclosed therein is a packet 20 which contains scented sawdust 22, the latter being illustrated using a draftsman's convention of partially breaking away a portion of the external wall of the packet to show the interior position of the sawdust. In practice, the packet 20, can be obtained from any one of a number of commercial sources, one such commercial source being the Dickinson Robinson Group of London, England. The preferred form of the scent source is as a sachet, wherein packet 20 is additionally disposed into a paper envelope 24, which may or may not have an imprinted design thereon. The combination of the envelope 24 and packet 20 provide what has herein been referred to as a sachet 26, the same being of the type that is available from a number of commercial sources, one such source being Woods of Windsor, Queen Charlotte Street, Windsor, Berkshire, Gt. Britain.

Referring again to FIG. 2, box 10, as already noted, is of cardboard construction material wherein the sides of the box, individually and collectively designated 28, cooperate to bound an internal compartment which, also as already noted, serves as a storage compartment for a supply stack of tissues 14. In preparing the box 10 for combination with the sachet 26, it is to be noted that in one of the cardboard sides 28 there are provided a pair of substantially parallel and vertically oriented perforations 30 and 32. As understood, the perforations 30 and 32 are advantageously imparted in the cardboard side 28 in the manufacture of the box 10 and thus, when the cardboard is a flat work-in-process blank from which the three dimensional box is constructed by appropriate folding of the blank.

Figure 2:
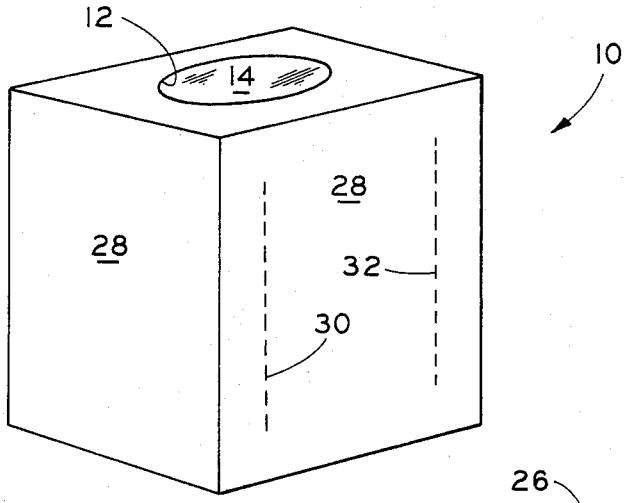
FIG. 2 is a perspective view of a paper tissue-dispensing container or box which is another component of the within inventive combination.
Figure 3:
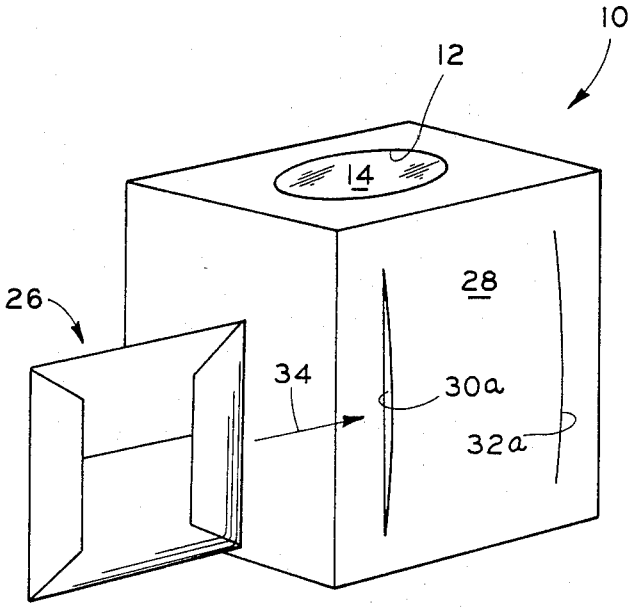
FIG. 3 is a perspective view illustrating how the components of the combination are assembled.

Proceeding from FIG. 2 to FIG. 3 it will be understood that the perforations 30 and 32 are changed in form to actual vertical slits 30*a* and 32*a*, respectively. Following this change, the sachet 26 is inserted, as indicated by the arrow 32, through the slits 30*a*, 32*a* so that a significant medial portion of the sachet 26 occupies an interposed position wherein the interior surface of the wall 28 between the slits 30 and 32*a* is on one side and the supply stack of tissues 14 is on its opposite side.

Figure 4:
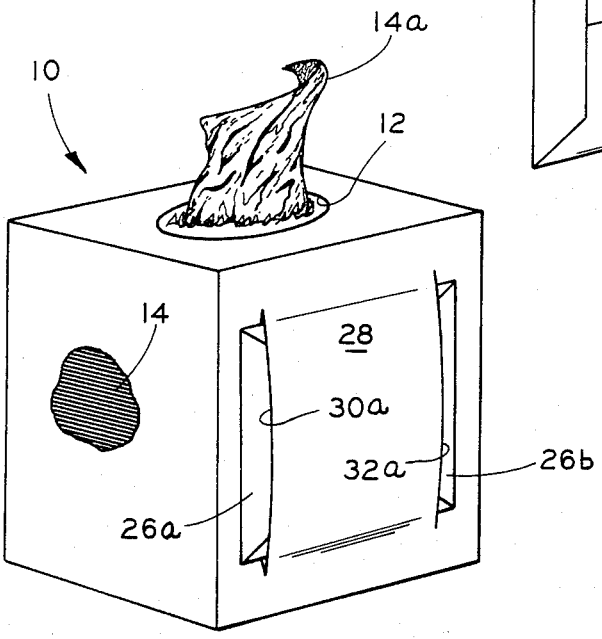
FIG. 4 is a perspective view of the assembled combination.

The operative position of the components 26 and the box 10 as well as the supply stack of tissues 14 in the latter, is shown in their assembled condition in FIG. 4, to which figure reference should now be made. As clearly shown in FIG. 4, the size of the sachet 26 is selected so that the opposite ends 26*a* and 26*b* thereof extend beyond the slits 30*a* and 32*a*, and in this manner the sachet 26 is held in place in its position adjacent the internal supply stack of tissues 14. More particularly, this adjacent position between the sachet 26 and the supply stack of paper tissues 14 results in the scent from the packet 20 being imparted to the tissues and, more particularly, to each tissue 14*a* that is removed one at a time from the supply stack through the box opening 12. Moreover, it has been found in practice that the sachet 26 is effective in providing this scent-imparting function for a prolonged period of time, in some instances for several weeks, despite the fact that the tissue box 10 is normally in an open area, such as a bathroom or bedroom, and thus not within a typical confined area such as a bureau drawer or the like. It is believed that a possible explanation is that the absorbency of the paper tissues 14 promotes the transfer of the scent from the sachet 26 to the tissues rather than in a reverse direction through the cardboard wall 28 to the atmosphere, which would soon dissipate the scent or aroma in such a short period of time as to provide no useful benefit.

While the combination as described is preferred, it will be understood that a latitude of modification, change and substitution is intended in the foregoing disclosure and that in some instances some features of the invention will be employed without a corresponding use of other features. Accordingly, it is appropriate that the appended claims be construed broadly and in a manner consistent with the spirit and scope of the invention herein.

What is claimed is:

1. A tissue-dispensing container of cardboard construction material of the type having walls including opposite side walls bounding a storage compartment and a stored supply stack of horizontally oriented absorbent paper tissues disposed in said storage compartment for removal one-at-a-time from the top of said stack, the improvement thereto comprising, in combination, a selected scent disposed in a porous cardboard packet of slightly smaller size than one said container side wall, and an operative position of said porous cardboard packet in physical contact with the edges of said horizontally oriented tissues which form the side of said absorbent supply stack of tissues so as to establish by said physical contact a seal against loss of fragrance from said container, said operative position consisting of an interposed position of said packet between said tissue supply stack and one said side wall so as to contribute to the transfer of the scent from said packet to said absorbent supply stack of paper tissues, said operative position being maintained by the projection of opposite sides of said packet through cooperating vertically oriented slits in said container side wall, whereby tissues removed from said container exhibit said scent by reason of said scent-absorbing adjacent position with said packet while said confined storage compartment for said tissues contributes to prolonging the time duration of the availability of said scent in said tissues.

* * * * *